US007552535B2

(12) United States Patent
Dicesare

(10) Patent No.: US 7,552,535 B2
(45) Date of Patent: Jun. 30, 2009

(54) METHOD OF FORMING HYDROFORMED MEMBER WITH OPENING

(75) Inventor: John Dicesare, Kitchner (CA)

(73) Assignee: Magna International Inc., Aurora, Ontario (CA)

( * ) Notice: Subject to any disclaimer, the term of this patent is extended or adjusted under 35 U.S.C. 154(b) by 492 days.

(21) Appl. No.: 10/534,654

(22) PCT Filed: Nov. 12, 2003

(86) PCT No.: PCT/US03/36105

§ 371 (c)(1),
(2), (4) Date: Dec. 5, 2005

(87) PCT Pub. No.: WO2004/043623

PCT Pub. Date: May 27, 2004

(65) Prior Publication Data

US 2006/0107512 A1 May 25, 2006

Related U.S. Application Data

(60) Provisional application No. 60/425,254, filed on Nov. 12, 2002.

(51) Int. Cl.

| | |
|---|---|
| ***B21D 47/00*** | (2006.01) |
| ***B21D 47/02*** | (2006.01) |
| ***B21D 51/00*** | (2006.01) |
| ***B21D 26/02*** | (2006.01) |

(52) U.S. Cl. ..... 29/897; 29/897.2; 29/421.1; 72/54; 72/55; 72/58; 72/60; 72/61; 72/370.22; 72/370.27

(58) Field of Classification Search ..... 29/897, 29/897.2, 421.1; 72/54, 55, 56, 58, 60, 61, 72/370.06, 370.22, 370.27
See application file for complete search history.

(56) References Cited

U.S. PATENT DOCUMENTS

| | | | | |
|---|---|---|---|---|
| 5,460,026 | A * | 10/1995 | Schafer | 72/55 |
| 5,666,840 | A * | 9/1997 | Shah et al. | 72/55 |
| 5,816,089 | A * | 10/1998 | Marando | 72/55 |
| 5,974,846 | A * | 11/1999 | Ash | 72/55 |
| 6,401,507 | B1 | 6/2002 | Krcek et al. | |
| 6,418,607 | B1 * | 7/2002 | Seifert et al. | 29/421.1 |
| 6,591,648 | B1 * | 7/2003 | Ash et al. | 72/55 |
| 6,658,908 | B1 * | 12/2003 | Ghiran et al. | 72/55 |
| 6,662,611 | B2 * | 12/2003 | Janssen et al. | 72/55 |

FOREIGN PATENT DOCUMENTS

| | | | |
|---|---|---|---|
| EP | 0 844 034 | A | 5/1998 |
| EP | 0 940 200 | A | 9/1999 |
| EP | 0 995 513 | A | 4/2000 |
| WO | WO 0162410 | A2 * | 8/2001 |

* cited by examiner

*Primary Examiner*—Jermie E Cozart
(74) *Attorney, Agent, or Firm*—Harness, Dickey & Pierce, P.L.C.

(57) ABSTRACT

A method for manufacturing a hydroforming member includes the step of providing a blank (10). The blank (10) is defined by blank wall (16). The blank (10) is placed in a die assembly (14) having a die cavity (12) defined by a die surface (24). The blank (10) is expanded so that the blank wall (16) is forced against the die surface (24) to form the hydroformed member. A portion of the blank wall conforms against a wall-thinning element (26, 28) positioned along the die surface (24) to form a removable wall section (46, 50) in a portion of the blank wall (24). The removable wall section (46, 50) is then removed from the blank wall (16) to form an opening in the hydroformed member.

10 Claims, 4 Drawing Sheets

METHOD OF FORMING HYDROFORMED MEMBER WITH OPENING

CROSS REFERENCE TO RELATED APPLICATION

This application claims the benefit of and priority from U.S. Provisional Patent Application Ser. No. 60/425,254, filed Nov. 12, 2002.

BACKGROUND OF THE INVENTION

1. Field of the Invention

This invention relates to a method of manufacturing a hydroformed member. More particularly, the invention relates to a method of manufacturing a hydroformed member with an opening.

2. Description of Related Art

Hydroforming is a process in which high pressure fluid is utilized to move a blank into conformity with a die surface of a die assembly. In one example, a tubular blank may be expanded to conform with the die surface to form a tubular hydroformed member. It may sometimes be required to form a tubular member with one or more openings. These openings may be made during the manufacture of the hydroformed member. For example, laser cutting may be used to form at least one removable wall section along the tubular member. The removable wall section is then removed to form the opening. Laser cutting is, however, time consuming and expensive, both of which increase manufacturing costs.

SUMMARY OF THE INVENTION

According to one aspect of the invention, a method of manufacturing a hydroformed member includes the step of providing a blank that is defined by a blank wall. The blank is placed in a die assembly having a die cavity defined by a die surface. The blank is expanded so that the blank wall is forced against the die surface in order to form the hydroformed member. A portion of the blank wall conforms against a wall-thinning element positioned along the die surface to form a removable wall section in a portion of the blank wall. The removable wall section is then removed from the blank wall to form an opening in the hydroformed member.

BRIEF DESCRIPTION OF THE DRAWINGS

Advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
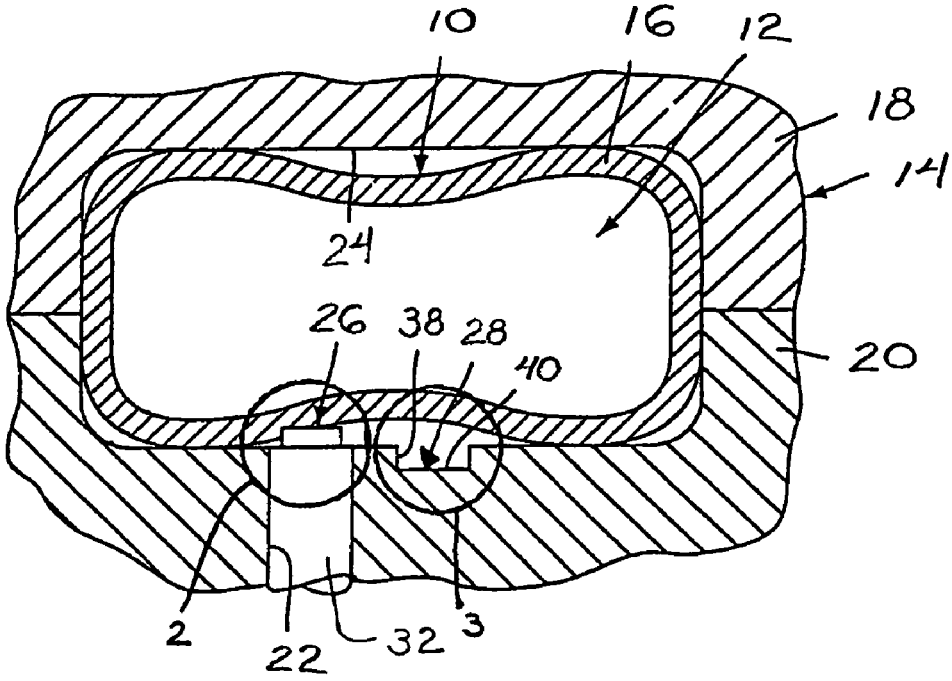
FIG. 1 is a cross-sectional view of a blank positioned in a die assembly for use in a method of manufacturing a hydroformed member according to the invention.
Figure 2:
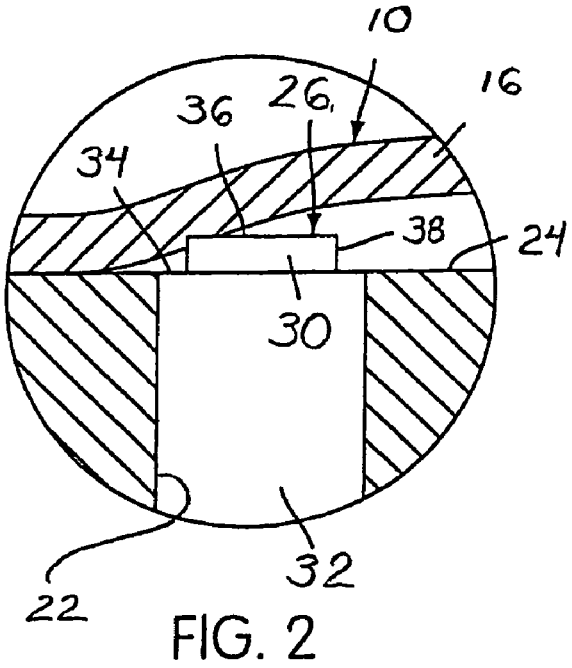
FIG. 2 is an enlarged, cross-sectional view of circle 2 in FIG. 1.
Figure 3:
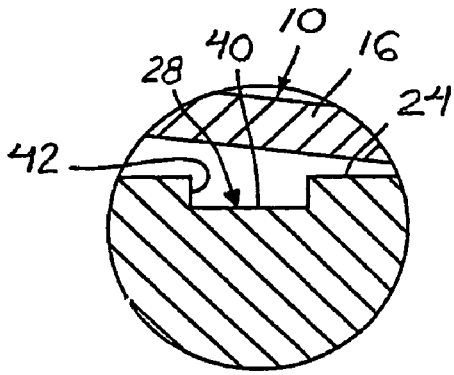
FIG. 3 is an enlarged, cross-sectional view of circle 3 in FIG. 1.

Referring to FIGS. 1 through 3, a tubular blank, generally indicated at 10, is disposed within a die cavity 12 of a die assembly, generally indicated at 14. The blank 10 is formed from a metal material, and includes a blank wall 16.

The die assembly 14 includes upper 18 and lower 20 die halves. The upper 18 and lower 20 die halves define the die cavity 12. In addition, the upper 18 and lower 20 die halves move towards and away from each other to selectively allow access to the die cavity 12. The lower die half 20 includes a die opening 22 that opens into the die cavity 12. It should, however, be appreciated that the die opening 22 may be formed in the upper die half 18.

A die surface 24 extends along the upper 18 and lower 20 die halves of the die assembly 14, and further defines the die cavity 12. The die surface 24 includes a pair of wall thinning elements 26, 28. One of the wall thinning elements 26, 28 is a projecting structure 26. The projecting structure 26 includes an extension 30 extending inwardly from the die surface 24 into the die cavity 12. The other wall thinning element 26, 28 is a recessed portion 28. The recessed portion 28 extends out from the die surface 24 away from the die cavity 12.

The projecting structure 26 is mounted within the die opening 22. More specifically, the projecting structure 26 includes a base portion 32 disposed within the die opening 22. The base portion 32 has a transverse cross-section that corresponds to a transverse cross-section of the die opening 22. Thus, the base portion 32 is sized to fit within the die opening 22. The base portion 32 includes an upper surface 34 that is flush with the surrounding die surface 24.

The extension 30 extends upwardly from the upper surface 34 of the base portion 32. The extension 30 is a generally cylindrical structure having a circular transverse cross-section. The extension 30 includes a circular, planar top surface 36 and an annular wall 38. The top surface 36 is generally parallel to and spaced from the die surface 24 and the upper surface 34 of the base portion 32. The annular wall 38 extends between the upper surface 34 and the top surface 36.

The projecting structure 26 is removably secured within the die opening 22. As a result, the projecting structure 26 can be replaced with other projecting structures of varying size and shape. Alternatively, the projecting structure 26 may be integrally formed with one of the upper 18 and lower 20 die halves.

The recessed portion 28 is spaced apart from the projecting structure 26 along the die surface 24. The recessed portion 28 includes a circular bottom surface 40 and a side wall 42 extending upwardly therefrom. The bottom surface 40 is generally parallel to the die surface 24 immediately surrounding the recessed portion 28.

It should be appreciated that although a pair of wall thinning elements is disclosed, the number of wall thinning elements positioned along the die surface 24 may vary. It should also be appreciated that although the wall thinning elements 26, 28 have been shown and described as a cylindrical projecting structure and a cylindrical recessed portion, the particular shape of the wall thinning elements 26, 28 may vary.

When the blank 10 is initially placed in the die assembly 14, as is shown in FIGS. 1 through 3, portions of the blank wall 16 are disposed along the die surface 24. At the same time, other portions of the blank wall 16 extend away from the die surface 24 and into the die cavity 12. A pressurized fluid is introduced into the die assembly 14 to force the entire blank wall 16 towards the die surface 24. The fluid pressure is gradually increased, as is shown in FIGS. 1, 4, and 7, until the blank wall 16 fully conforms to the die surface 24 to form a hydroformed member, generally shown at 44 in FIG. 7.

Figure 4:
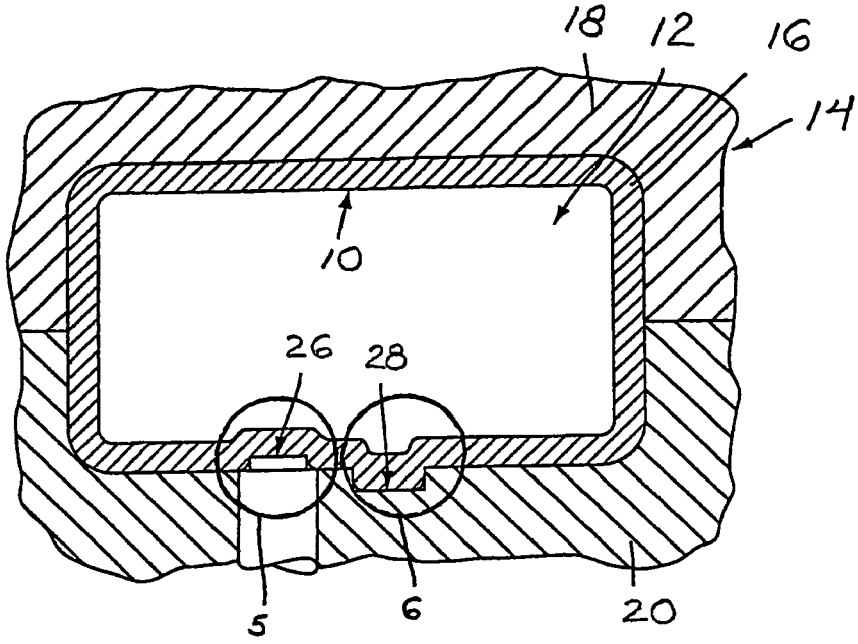
FIG. 4 is a cross-sectional view of the blank showing a blank wall partially conformed against a die surface of the die assembly.
Figure 5:
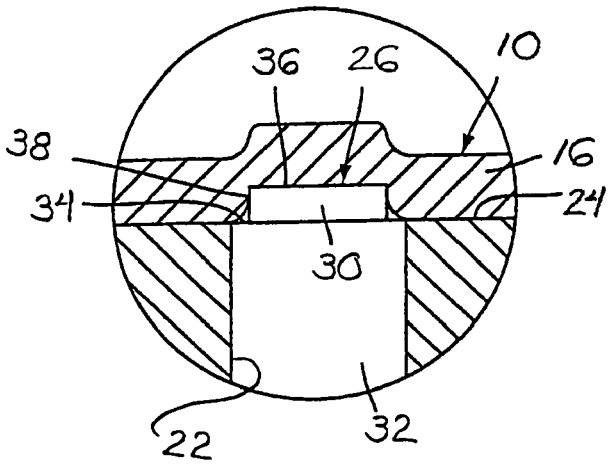
FIG. 5 is an enlarged, cross-sectional view of circle 5 in FIG. 4.
Figure 6:
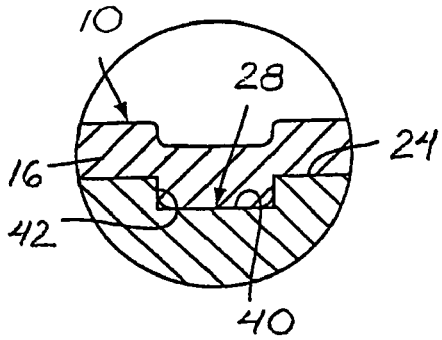
FIG. 6 is an enlarged, cross-sectional view of circle 6 in FIG. 4.

The configuration of the blank wall 16 within the die assembly 14 at an intermediate pressure is shown in FIGS. 4 through 6. Referring to FIG. 4, the introduction of pressurized fluid expands the blank 10 and forces the entire blank wall 16 against the die surface 24. The blank wall 16 begins to conform against the projecting structure 26 and the recessed portion 28. At this time, however, the blank wall 16 is not completely conformed against the wall thinning elements 26, 28. In particular, the blank wall 16 is only partially conformed against the annular wall 38, as is shown in FIG. 5. Additionally, the blank wall 16 is only partially conformed against the bottom surface 40 of the recessed portion 28, as is shown in FIG. 6.

Figure 7:
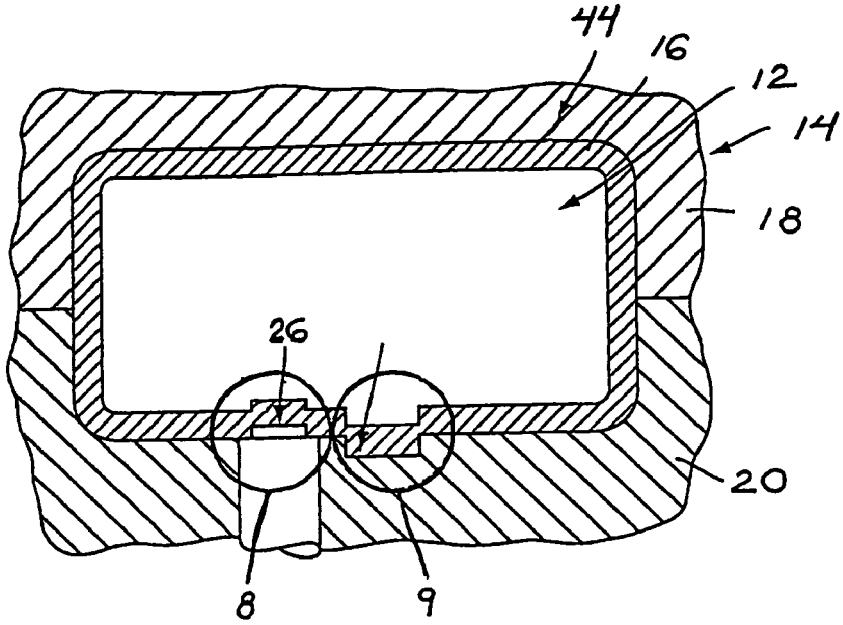
FIG. 7 is a cross-sectional view of the blank showing the blank wall completely conformed against the die surface.
Figure 8:
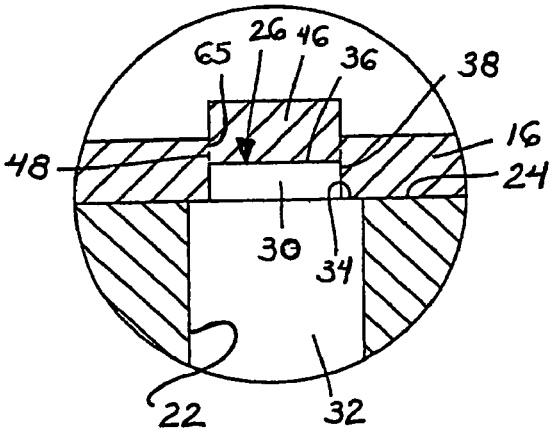
FIG. 8 is an enlarged, cross-sectional view of circle 8 in FIG. 7.
Figure 9:
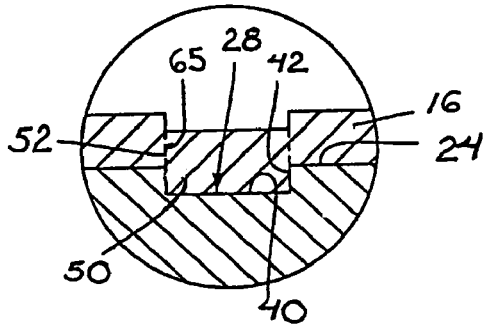
FIG. 9 is an enlarged, cross-sectional view of circle 9 in FIG. 7.
Figure 14:
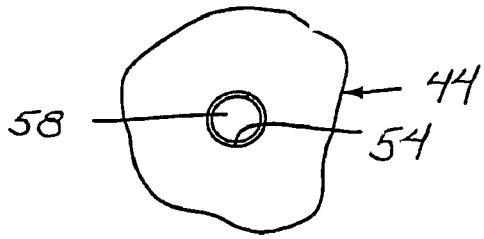
FIG. 14 is a view of the hydroformed member and one of the punches taken along line 14-14 in FIG. 13.

Referring to FIGS. 7 through 9, as the hydroforming of the blank 10 is completed, the blank wall 16 is fully conformed against the die surface 24, the projecting structure 26, and the recessed portion 28. A first removable wall section 46 of the blank wall 16 is disposed along the top surface 36 of the extension 30. The blank wall 16 includes a first perimeter area 48 surrounding the first removable wall section 46. The first perimeter area 48 has a reduced, cross-sectional thickness relative to adjacent portions of the blank wall 16.

Similarly, a second removable wall section 50 of the blank wall 16 is disposed along the bottom surface 40 of the recessed portion 28. The blank wall 16 includes a second perimeter area 52 surrounding the second removable wall section 50. The second perimeter area 52 has a reduced, cross-sectional thickness relative to adjacent portions of the blank wall 16. Thus, the wall thinning elements 26, 28 cause localized thinning of the blank wall 16.

As the blank 10 expands outwardly, the blank wall 16 is subjected to a shear force around the edge of the top surface 36 of the extension 30. Similarly, the blank wall 16 is subjected to a shear force around the edge of the die surface 24 surrounding the side wall 42. The shear force creates stress fractures 65 in the blank wall 16 at the first 48 and second 52 perimeter areas. The stress fractures 65 are helpful during removal of the first 46 and second 50 removable wall sections from the blank wall 16.

Referring to FIGS. 10 through 14, upon completion of the hydroforming process, the hydroformed member 44 is moved out of the die assembly 14. The first removable wall section 46 projects inwardly from the blank wall 16 while the second removable wall section 50 projects outwardly from the blank wall 16. One or both of the first 46 and second 50 removable wall sections, which are generally circular, are removed to form openings 54, 56 in the hydroformed member 44. Removal of at least one of the first 46 and second 50 removable wall sections is achieved by striking the removable wall sections 46, 50 with a force sufficient to completely separate the removable wall sections 46, 50 from the blank wall 16 in the area of the first 48 and second 52 perimeter areas. The reduced wall thickness at the first 48 and second 52 perimeter areas facilitates the removal of the first 46 and second 50 removable wall sections. It should be appreciated that the removable wall sections 46, 50 can be formed in a wide range of sizes and shapes in various locations along the hydroformed member 44 to form openings of various sizes and shapes.

In a preferred embodiment, punches 58, 60 are used to remove one or both of the first 46 and second 50 removable wall sections from the blank wall 16. Each punch 58, 60 is cylindrical and has a striking surface 62 that is approximately the same size and shape as the first 46 and second 50 removable wall sections. It is however, contemplated that the size and/or shape of the striking surface 62 may differ from the first 46 and second 50 removable wall sections.

Figure 10:
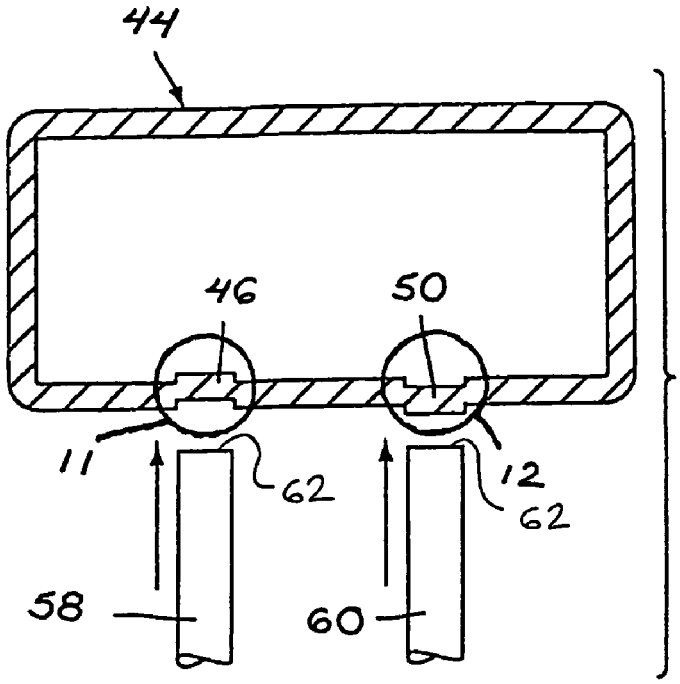
FIG. 10 is a cross-sectional view of a hydroformed member including first and second removable wall sections.
Figure 11:
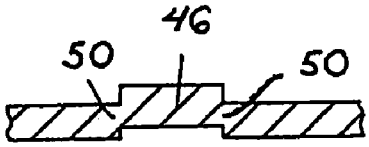
FIG. 11 is an enlarged, cross-sectional view of circle 11 in FIG. 10.
Figure 12:
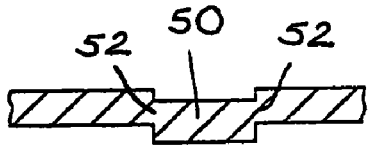
FIG. 12 is an enlarged, cross-sectional view of circle 12 in FIG. 11.
Figure 13:
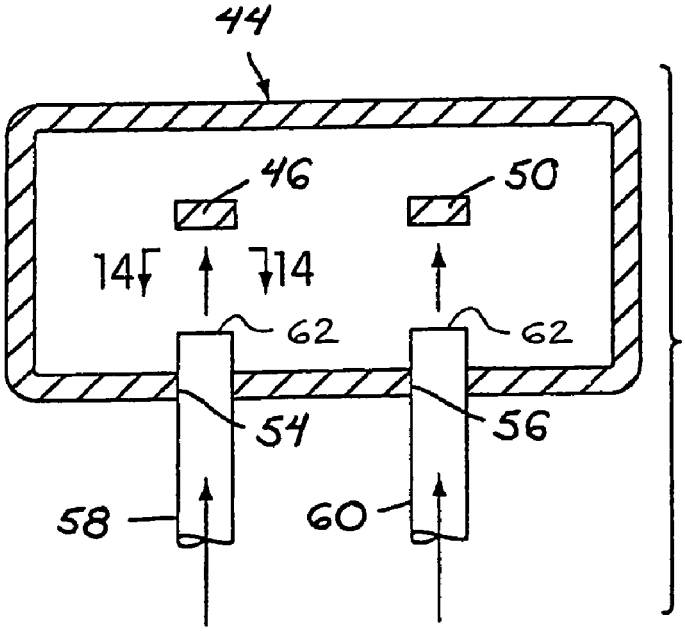
FIG. 13 is a cross-sectional view of the hydroformed member and first and second punches removing the first and second removable wall sections.

The punches 58, 60 may strike the respective first 46 and second 50 removable wall sections a single time or multiple times in order to remove the first 46 and second 50 removable wall sections from the blank wall 16. Referring to FIG. 10, it is appreciated that the punches 58, 60 strike from outside of the hydroformed member 44 to remove the first 46 and second 50 removable wall sections. At the same time, it is also appreciated that the punches 58, 60 may be positioned in the interior of the hydroformed member 44 to remove the first 46 and second 50 removable wall sections from within.

Although complete removal of the first 46 and second 50 removable wall sections from the blank wall 16 has been described, it is also contemplated to form a hydroformed member in which a thin-walled perimeter area partially surrounds a portion of the blank wall 16 to form a flange or similar outwardly extending structure. For example, a wall-thinning element could be included in a die assembly that forms a U-shaped, thin-walled perimeter area around a portion of the blank wall 16 so that an angularly extending flange is formed on the hydroformed member 44 when the thin-walled perimeter area is struck.

In a method of manufacturing a hydroformed member according to the invention, the blank 10 defining the blank wall 16 is provided. The blank 10 is placed within the die assembly 14, which includes the die cavity 12 defined by the die surface 24. A pressurized fluid is introduced into the die cavity 12 to expand the blank 10. As a result, the blank wall 16 is forced against the die surface 24 to form the hydroformed member 44. The blank wall 16 is completely conformed against the wall thinning elements 26, 28 along the die surface 24 to form the first 46 and second 50 removable wall sections along the blank wall 16. The first 46 and second 50 removable wall sections have respective first 48 and second 52 perimeter areas of reduced wall thickness. At the same time, stress fractures 65 may be created at the first 48 and second 52 perimeter areas of the blank wall 16. The hydroformed member 44 is then moved out of the die assembly 14. Finally, the first 46 and second 50 removable wall sections are removed from the blank wall 16 to form the openings 56, 58 in the hydroformed member 44. The reduced wall thickness of the first 48 and second 52 perimeter areas of the blank wall 16 facilitates the removal of the first 46 and second 50 removable wall sections. The removal of the first 46 and second 50 removable wall sections is further facilitated by the stress fractures 65.

The invention has been described in an illustrative manner. It is to be understood that the terminology, which has been used, is intended to be in the nature of words of description rather than of limitation. Many modifications and variations of the invention are possible in light of the above teachings. Therefore, within the scope of the appended claims, the invention may be practiced other than as specifically described.

What is claimed:

1. A method of manufacturing a hydroformed member comprising the steps of:

providing a blank defined by a blank wall;

placing the blank in a die assembly having a die cavity defined by a die surface;

positioning a contact surface of a wall-thinning element offset from the die surface;

expanding the blank by introducing pressurized fluid into the blank to force the blank wall against the die surface and the offset contact surface to form the hydroformed member;

reducing a wall thickness of the blank during the expanding step to form a removable wall section in a portion of the blank wall; and removing the removable wall section from the blank wall to form an opening in the hydroformed member, wherein the removing step includes striking the removable wall section.

2. A method as set forth in claim 1 wherein the removing step includes striking the removable wall section multiple times.

3. A method as set forth in claim 1 wherein the reducing step includes partially fracturing a portion of the blank wall surrounding the removable wall section.

4. A method of manufacturing a hydroformed member comprising:

providing a tubular blank defined by a blank wall;

placing the blank in a die assembly having a die cavity defined by a die surface;

positioning a wall-thinning element along the die surface;

introducing pressurized fluid into the blank to force the blank wall against the die surface and the wall-thinning element to reduce the thickness of the blank wall adjacent the wall-thinning element and form a removable wall section in a portion of the hydroformed member; and removing the removable wall section to form an opening in the hydroformed member, wherein the removing step includes striking the removable wall section, and further wherein the method includes partially fracturing a portion of the blank wall surrounding the removable wall section as the thickness of the blank wall is reduced.

5. A method as set forth in claim 4 further including removing the hydroformed member from the die cavity prior to removing the removable wall section.

6. A method of manufacturing a hydroformed member comprising:

providing a tubular blank defined by a blank wall;

placing the blank in a die assembly having a die cavity defined by a die surface;

positioning a wall-thinning element along the die surface;

introducing pressurized fluid into the blank to force the blank wall against the die surface and the wall-thinning element to reduce the thickness of the blank wall adjacent the wall-thinning element and form a removable wall section in a portion of the hydroformed member; and removing the removable wall section to form an opening in the hydroformed member, wherein the removing step includes striking the removable wall section, the method further including positioning a contact surface of the wall-thinning element closer to the center of the die cavity than an adjacent portion of the die surface prior to the introduction of pressurized fluid into the blank.

7. A method of manufacturing a hydroformed member comprising:

providing a tubular blank defined by a blank wall;

placing the blank in a die assembly having a die cavity defined by a die surface;

positioning a wall-thinning element along the die surface;

introducing pressurized fluid into the blank to force the blank wall against the die surface and the wall-thinning element to reduce the thickness of the blank wall adjacent the wall-thinning element and form a removable wall section in a portion of the hydroformed member; and removing the removable wall section to form an opening in the hydroformed member, wherein the removing step includes striking the removable wall section, the method further including positioning a contact surface of the wall-thinning element further from the center of the die cavity than an adjacent portion of the die surface prior to the introduction of pressurized fluid into the blank.

8. A method of manufacturing a hydroformed member comprising the steps of:

providing a blank defined by a blank wall;

placing the blank in a die assembly having a die cavity defined by a die surface;

expanding the blank to force the blank wall against the die surface and form the hydroformed member;

conforming a portion of the blank wall against a wall-thinning element positioned along the die surface to form a removable wall section in a portion of the blank wall;

removing the removable wall section from the blank wall to form an opening in the hydroformed member; and moving the hydroformed member out of the die assembly prior to the step of removing the removable wall section from the blank wall to form the opening in the hydroformed member, the method further including positioning a contact surface of the wall-thinning element closer to the center of the die cavity than an adjacent portion of the die surface prior to the introduction of pressurized fluid into the blank.

9. A method of manufacturing a hydroformed member comprising the steps of:

providing a blank defined by a blank wall;

placing the blank in a die assembly having a die cavity defined by a die surface;

expanding the blank to force the blank wall against the die surface and form the hydroformed member;

conforming a portion of the blank wall against a wall-thinning element positioned along the die surface to form a removable wall section in a portion of the blank wall;

removing the removable wall section from the blank wall to form an opening in the hydroformed member; and moving the hydroformed member out of the die assembly prior to the step of removing the removable wall section from the blank wall to form the opening in the hydroformed member, the method further including positioning a contact surface of the wall-thinning element further from the center of the die cavity than an adjacent portion of the die surface prior to the introduction of pressurized fluid into the blank.

10. A method of manufacturing a hydroformed member comprising the steps of:

providing a blank defined by a blank wall;

placing the blank in a die assembly having a die cavity defined by a die surface;

expanding the blank to force the blank wall against the die surface and form the hydroformed member;

conforming a portion of the blank wall against a wall-thinning element positioned along the die surface to form a removable wall section in a portion of the blank wall;

removing the removable wall section from the blank wall to form an opening in the hydroformed member; and moving the hydroformed member out of the die assembly prior to the step of removing the removable wall section from the blank wall to form the opening in the hydroformed member, wherein the conforming step includes reducing the wall thickness adjacent the wall-thinning element.

* * * * *